US009099060B2

(12) United States Patent
Van Dyk

(10) Patent No.: US 9,099,060 B2
(45) Date of Patent: Aug. 4, 2015

(54) MAGNETIC RETURN PEDAL FOR PERCUSSION INSTRUMENTS

(71) Applicant: Michael Van Dyk, Denver, NC (US)

(72) Inventor: Michael Van Dyk, Denver, NC (US)

(73) Assignee: Michael Van Dyk, Denver, NC (US)

( * ) Notice: Subject to any disclaimer, the term of this patent is extended or adjusted under 35 U.S.C. 154(b) by 160 days.

(21) Appl. No.: 13/875,407

(22) Filed: May 2, 2013

(65) Prior Publication Data

US 2013/0291706 A1 Nov. 7, 2013

Related U.S. Application Data

(60) Provisional application No. 61/641,516, filed on May 2, 2012.

(51) Int. Cl.

| | |
|---|---|
| ***G10D 3/02*** | (2006.01) |
| ***G10D 13/00*** | (2006.01) |
| ***G10D 13/06*** | (2006.01) |

(52) U.S. Cl.

CPC ..... *G10D 13/006* (2013.01); *G10D 13/065* (2013.01)

(58) Field of Classification Search

CPC ..... G10D 13/006; G10D 13/065

USPC ..... 84/422.1

See application file for complete search history.

(56) References Cited

U.S. PATENT DOCUMENTS

| | | | | |
|---|---|---|---|---|
| 6,590,147 | B2 | 7/2003 | Kassabian | |
| 7,119,264 | B2 * | 10/2006 | Van Dyk | 84/422.1 |
| 2009/0235806 | A1 * | 9/2009 | Chen | 84/422.1 |

* cited by examiner

*Primary Examiner* — Jianchun Qin

(74) *Attorney, Agent, or Firm* — Clements Bernard PLLC; Seth L. Hudson

(57) ABSTRACT

The present invention provides methods and systems for a musical percussion instrument foot pedal that uses a pair of high gauss rated magnets, one under the foot pedal and one on the base below the foot pedal the magnets aligned for magnetic repulsion. The magnetic repulsion between the magnets return the pedal to its original position after having been depressed. An inclined magnet support on the base may allow stacking magnets, raising and lowering the height of the base magnet, or sliding the base magnet into greater and lesser alignment with the pedal magnet. The present invention also contains a pair of side plate assemblies that contain magnets on opposing ends and are aligned for magnetic repulsion in for aiding cam movement.

12 Claims, 6 Drawing Sheets

MAGNETIC RETURN PEDAL FOR PERCUSSION INSTRUMENTS

CROSS REFERENCE TO RELATED APPLICATION

The current application claims the benefit of the earlier priority filing dates of the provisional application, Ser. No. 61/641,516 that was filed on May 2, 2012.

FIELD OF THE INVENTION

The present invention relates to percussion instruments and particularly to a musical instrument foot pedal, which uses a pair of magnets, one under the foot pedal and one on the base below the foot pedal, and the magnetic repulsion therebetween to return the pedal to its original position after having been depressed. The present invention also contains a pair of side plate assemblies that contain magnets that are aligned for magnetic repulsion for aiding cam movement in the horizontal and vertical direction.

BACKGROUND OF THE INVENTION

The basic drum-kit consists of several drums, most of which are played by means of a stick in each hand, and a bass drum and cymbals and sometimes other percussion instruments which are played by depressing a foot pedal to swing a hammer to strike the drum or other percussion instrument or to pull down one cymbal on top of another to clang them together. The return mechanism on conventional pedals includes a spring, which supplies the force to return the pedal to its original position after having been depressed. The spring in such arrangements have often contributed unwanted metallic noises and interfere in the foot operation while playing.

Prior art U.S. Pat. No. 4,819,536, issued Apr. 11, 1989 to Lombardi, claims a foot-operated, bass drum pedal assembly including: a base in the form of a metal plate, a first drum beater, a support for the beater mounted on the base, and a pedal pivotally mounted to the base and operatively connected to the beater to pivot same as the pedal is pivoted by the drummer's foot, and structure (magnet on the pedal and Hall Effect Sensor on the base) located proximate the pedal to sense downward movement of the pedal to predetermined downward position, and to produce an electrical signal usable to effect production of phenomena corresponding to a drum beat. A single magnet was used on the bass drum foot pedal, but with a sensor on the base, not another magnet, and a spring lifts the pedal after pressing down.

Prior art U.S. Pat. No. 3,967,523, issued Jul. 6, 1976 to Currier, describes a power driven drum beater, which is controlled by means of a foot pedal. The pedal device serves to close an electrical circuit for the actuation of a pivoted solenoid actuated beater mounted on a rod. The foot pedal is further pivotable enabling an electrical contact on the underside thereof to be brought into a desired position along a resistance selector for driving the beater with variable speed or intensity and at a variable rate. The pedal return solenoid is disposed beneath the foot rest and is connected in said electrical circuit means for simulating the rebound or kickback of a conventional non-electric drum beater.

Prior art U.S. Pat. No. 6,684,734, issued Feb. 3, 2004 to Gatzen, provides a pedal assembly for a bass drum or for high hat cymbals. The pedal assembly has a flat base plate with a resilient pedal board clamped to it, with the pedal board inclined to receive a foot. A beater stick is connected with the toe end of the pedal board by a linkage that drives the beater stick against a bass drum when the pedal is depressed. The resiliency of the pedal board returns it to its normal position when foot pressure is withdrawn. A striker pad limits the depression of the pedal board to limit the force that the beater stick can apply to the drum.

Prior art U.S. Pat. No. 4,186,644, issued Feb. 5, 1980 to Kurosaki, shows a foot pedal assembly for drums, which comprises a rocker cam for holding a beater head and a resilient belt or strap for operationally connecting the rocker cam to an inclined foot pedal are coupled to each other via meshing engagement by cooperating indentations formed on mating surfaces of the two members. Tensile strength of the belt or strap is remarkably enhanced by fortifying members such as steel wires or glass fibers longitudinally embedded in the belt or strap. Stress concentration on a set screw for fixing the belt or strap to the rocker cam can be avoided, permanent strain of the belt or strap after long use is divided into mutually incumulative small fragments and reliable coupling between the belt or strap and the rocker cam assures fair conversion of foot action into beater head movement without undesirable metallic noises.

Prior art U.S. Pat. No. 4,235,146, issued Nov. 25, 1980 to Purdy, claims a bass drum pedal assembly that includes a foot pedal for operating a beater head, the foot pedal including a foot plate which is slidably mounted on a support coupled to the beater head and which is biased towards a rest position. In use, the player depresses the foot pedal and can, at the same time, slide the foot plate forward against its biasing. At the end of a stroke, the pedal returns upwardly and the foot plate is returned to its rest position by said biasing means.

Prior art U.S. Pat. No. 4,945,802, issued Aug. 7, 1990 to Ruprecht, discloses a pneumatic return for foot pedals associated with percussion instruments, such as bass drums and hi-hat stands. The assembly permits adjustable mounting of a drum beater bar, foot pedal and drive chain while providing automatic return of the pedal to a neutral position by means of gas compressed upon depression of the pedal. Gas pressure within the pneumatic return mechanism is also adjustable. There is further optionally provided a substantially identical pneumatic unit for damping the return movement of both the drum pedal and hi-hat stand.

Prior art U.S. Pat. No. 4,520,710, issued Jun. 4, 1985 to Elliott, Jr., indicates two pedal assemblies, for drum and cymbals, mounted together or usable separately. The drum pedal assembly has an inherent escapement mechanism. A drum beater is suspended from a shaft, which is rotated by downward movement of the foot pedal. After rotation to strike a drum, the drum beater returns to its rest position under the action of gravity once the downward force on the pedal is removed. The assembly is designed such that the drum beater counter-balances the foot pedal, decreasing the need for a spring typically employed to provide the escapement or return force. However, for faster return action, a secondary escapement force may be provided by an elastic band suspended between frame posts, which support the shaft. As the drum beater is rotated into the strike position, the elastic band is stretched into a bowed configuration.

Prior art U.S. Pat. No. 6,166,312, issued Dec. 26, 2000 to Brewster, puts forth a pedal operated drum beater device, which comprises a pedal and a drum beater mounted on shaft. The pedal is coupled to shaft by such that depressing the pedal causes the shaft to rotate, advancing the drum beater from a rest position to an operative position. The downward movement of the pedal is opposed by the resilience of elastomeric strip, which stretches and bends as the drum beater moves into the operative position. The device is attached to a drum by drum clamp, formed in two parts, which consist of a drum-mounted rim clamp and a device-mounted, clamp holder. The rim clamp and clamp holder are releasably interlockable through pivotal engagement.

Prior art U.S. Pat. No. 3,797,356, issued Mar. 19, 1974 to Duffy, illustrates a linkage for a foot-operated bass drum pedal in which the conventional leather strip interconnecting the toe end of the pedal and a tranversely mounted shaft carrying means for securing the pivoting end of the drumstick is replaced by a sprocket chain engaging a sprocket on said shaft. Coarse adjustment of the length of the stroke is obtained by shifting the mounting means on the shaft. Fine adjustment is obtained by shifting the end point of the chain with respect to the particular teeth engaged on the sprocket. The last link of the sprocket end of the chain is secured by pintel or cotter keys extended through one of a plurality of transversely extending holes located at the periphery of the socket adjacent the inner end of the teeth thereof. There is also provided a vertically disposed coil spring, the lower end of which has a threaded tensioning means. The contraction of the spring serves to return the pedal to a position of readiness for subsequent operation.

Prior art U.S. Pat. No. 4,965,417, issued Oct. 23, 1990 to Massie, provides a control mechanism adapted for actuation by a human, in the exemplary embodiment by a person's foot. The invention provides for control or actuation of a plurality of devices to be controlled. A plurality of control elements, preferably arranged arcuately with respect to an actuating member is provided with a structure for accurately indexing the actuating member to a particular control element by way of one mode of movement and for actuating an individual indexed control element of a second mode of movement. Particular structure is provided, by way of a foot pedal, in the exemplary embodiment, with particular adjustments so as to adapt the actuating member, that is, the foot pedal, to various sizes and positions of an operator's foot, as well as amplitude of actuating movement.

Prior art U.S. Patent Application No. 20030148853, published Aug. 7, 2003 by Alessandri, describes an apparatus for physical exercise with magnetic interaction between its parts. The physical exercise apparatus for recreational, rehabilitative, gymnastic or sports purposes comprises at least one mobile part and at least one support part, interacting by means of field forces generated by magnetic fields inserted between relative parts of which the apparatus is made.

What is needed is a percussion instrument pedal with a pair of opposing magnets using magnetically opposing force fields to lift the pedal silently and smoothly after depression of the pedal by the foot of the musician.

BRIEF SUMMARY OF THE INVENTION

According to an embodiment of the present invention, an object of the present invention is to provide a percussion instrument pedal with a pair of opposing high powered magnets one the pedal and one the base using magnetically opposing force fields to lift the pedal silently and smoothly after depression of the pedal by the foot of the musician for a return mechanism which operates more smoothly and silently than mechanical means and also will not wear out from use.

Another object of the present invention is to provide a first magnet on the bottom of the foot pedal and a second magnet oriented in polar opposition to the first magnet on a base directly below the first magnet with the base angled upwardly away from the heel of the pedal so that the two magnets are almost in contact at the low point of the depression of the pedal for maximum repulsion between the magnets to cause the pedal to respond instantly in returning to the upright position.

One more object of the present invention is to provide a series of stacked magnets of varying intensity aligned between the bottom of the foot pedal and the base with opposing force fields to create a gradual smooth upward force on the pedal after depression of the pedal by the foot of the musician.

A further object of the present invention is to provide adjustable height magnets in the base to vary the proximity between the base magnets and the pedal magnets and therefore vary the repulsive force between the base magnets and the pedal magnets to change the play of the pedal in terms of resistance in pressing the pedal down and speed of return of the pedal.

A related object of the present invention is to provide slidably adjustable magnets on the base to change the alignment of the base magnets with the pedal magnets and thereby vary the repulsive force between the base magnets and the pedal magnets to change the play of the pedal in terms of resistance in pressing the pedal down and speed of return of the pedal.

In brief, a pair of powerful magnets with a high gauss rating are attached, one on the bottom of the percussion instrument foot pedal and one on the base directly below the foot pedal, the pair of magnets aligned with opposing force fields creating a repulsion between the pair of magnets to force the foot pedal upward after depression by the musician.

An angled magnet mounting platform can be attached to the base below the pedal with the platform angled upwardly away from the heel of the pedal so that the two magnets are almost in contact at the low point of the depression of the pedal for maximum repulsion between the magnets to cause the pedal to respond instantly in returning to the upright position.

In addition, various sizes of stacked magnets may also be mounted in alignment between the bottom of the foot pedal and the base with opposing force fields to create a more gradual smooth upward force on the pedal after depression of the pedal by the foot of the musician.

The repulsive force between the magnets on the bottom of the pedal and the magnets on the base may be varied by adjusting the distance between to two sets of magnets by having a height adjustable base or by offsetting the magnets by having the magnets in the base slidable to align or offset the base magnets with the pedal magnets as desired.

An additional advantage of the present invention is that is also contains a pair of side plate assemblies that contain magnets that are aligned for magnetic repulsion for aiding cam movement in the horizontal and vertical direction.

An advantage of the present invention is that it operates smoothly.

A further advantage of the present invention is that the repulsive forces between magnets may be adjusted as desired to change the return speed of the pedal and the resistance in pressing the pedal down.

Another advantage of the present invention is that it operates quietly.

An additional advantage of the present invention is that it may be added to existing drum kits.

One more advantage of the present invention is that it is easy to install.

Yet another advantage of the present invention is that it is inexpensive.

Still another advantage of the present invention is that it will not wear out from use.

BRIEF DESCRIPTION OF THE DRAWINGS

The present invention is illustrated and described herein with reference to the various drawings, in which like reference numbers denote like method steps and/or system components, respectively, and in which:

FIG. 7 is a side view of the side plate assembly;

DETAILED DESCRIPTION OF THE INVENTION

Figure 1:
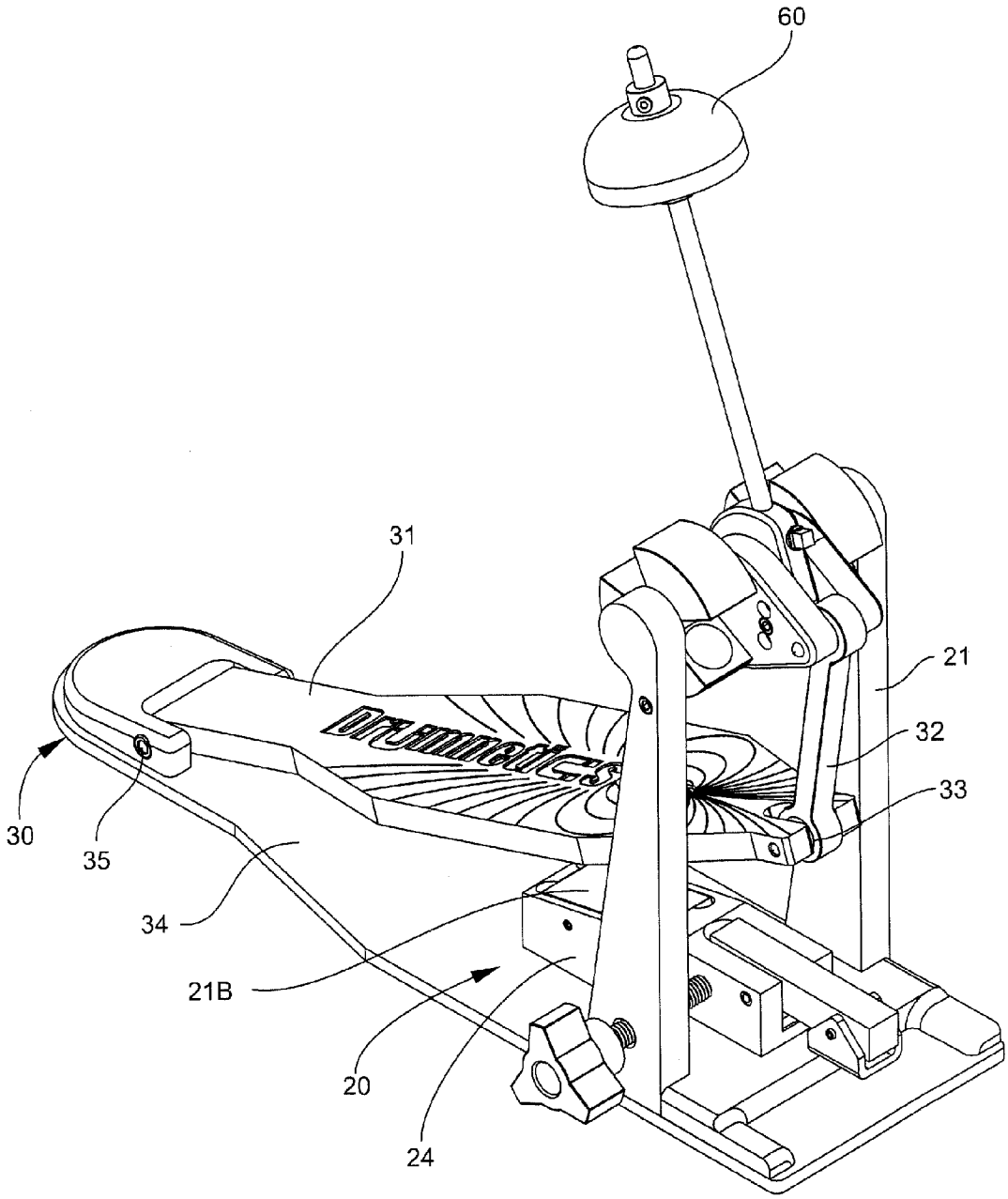
FIG. 1 is a perspective view of the magnetic return pedal.
Figure 2:
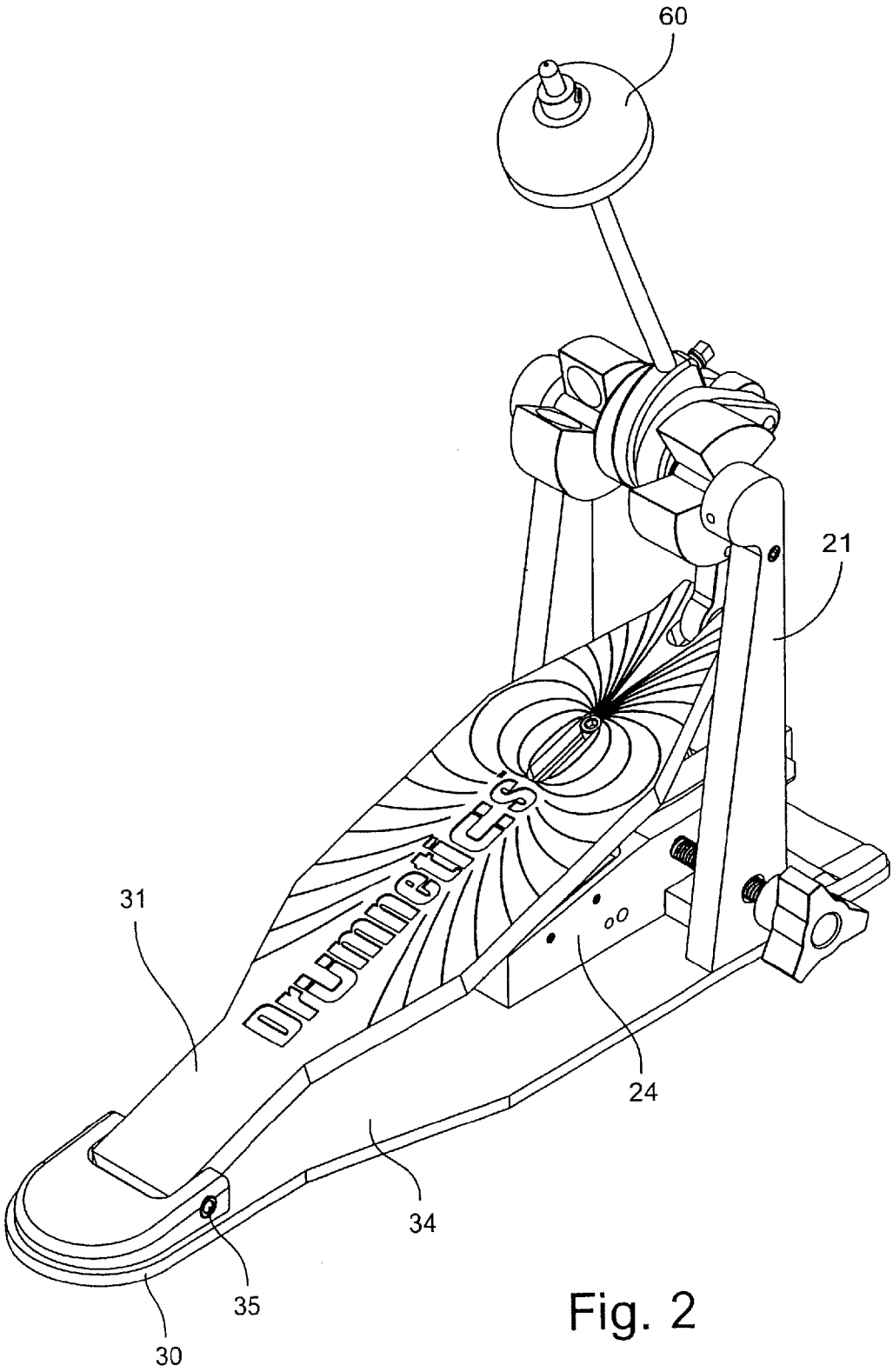
FIG. 2 is a perspective view of the magnetic return pedal.
Figure 4:
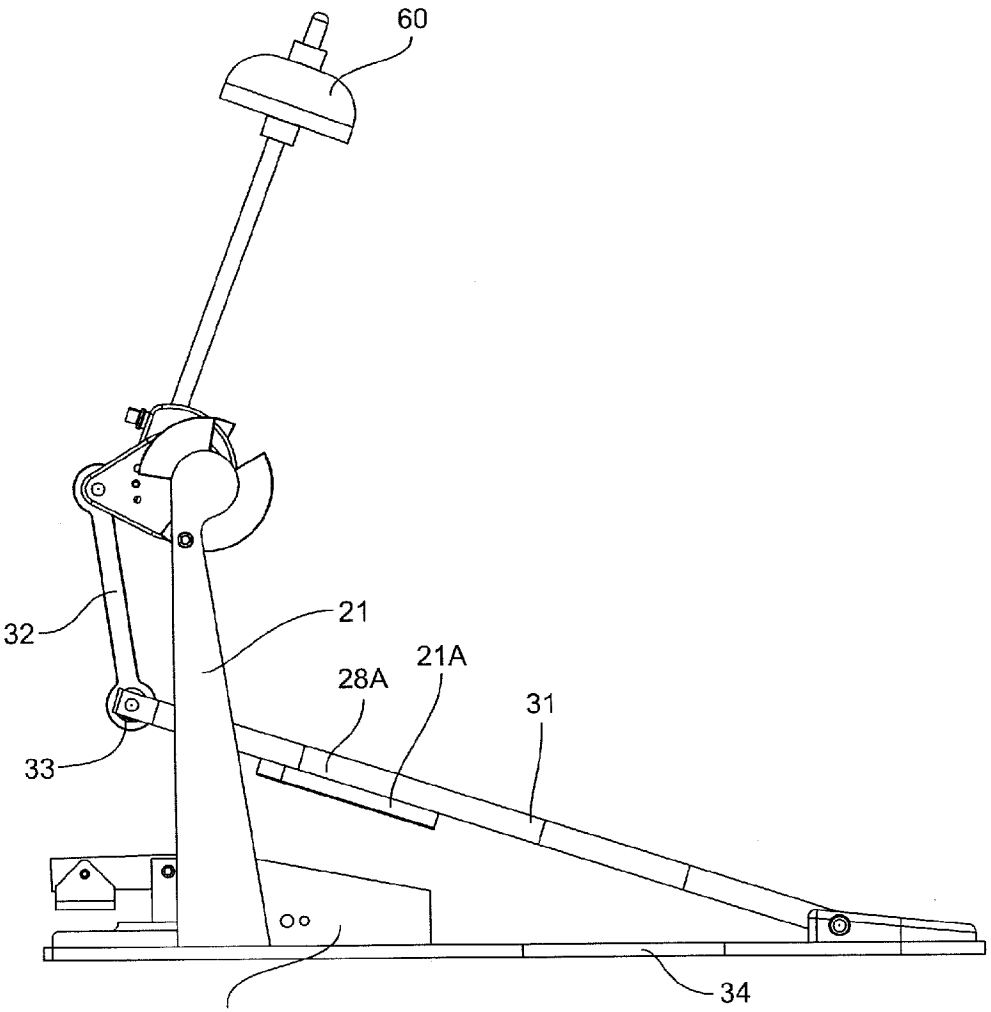
FIG. 4 is a is a side view of the magnetic return pedal.
Figure 3:
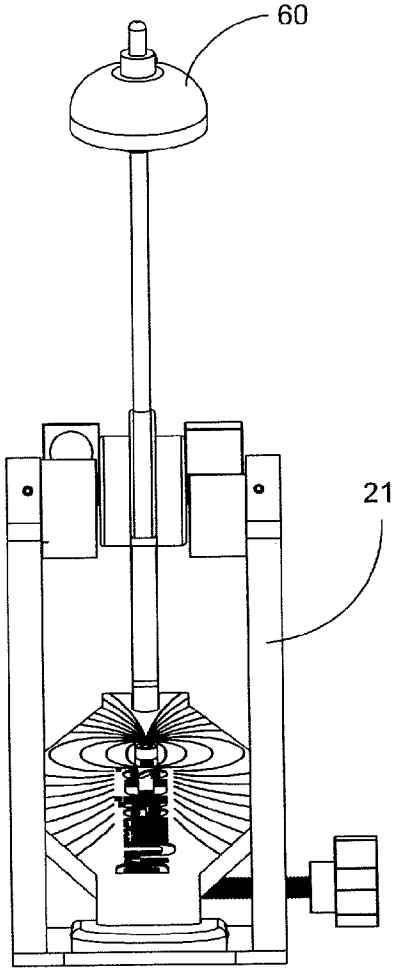
FIG. 3 is a rear view of the magnetic return pedal.
Figure 5:
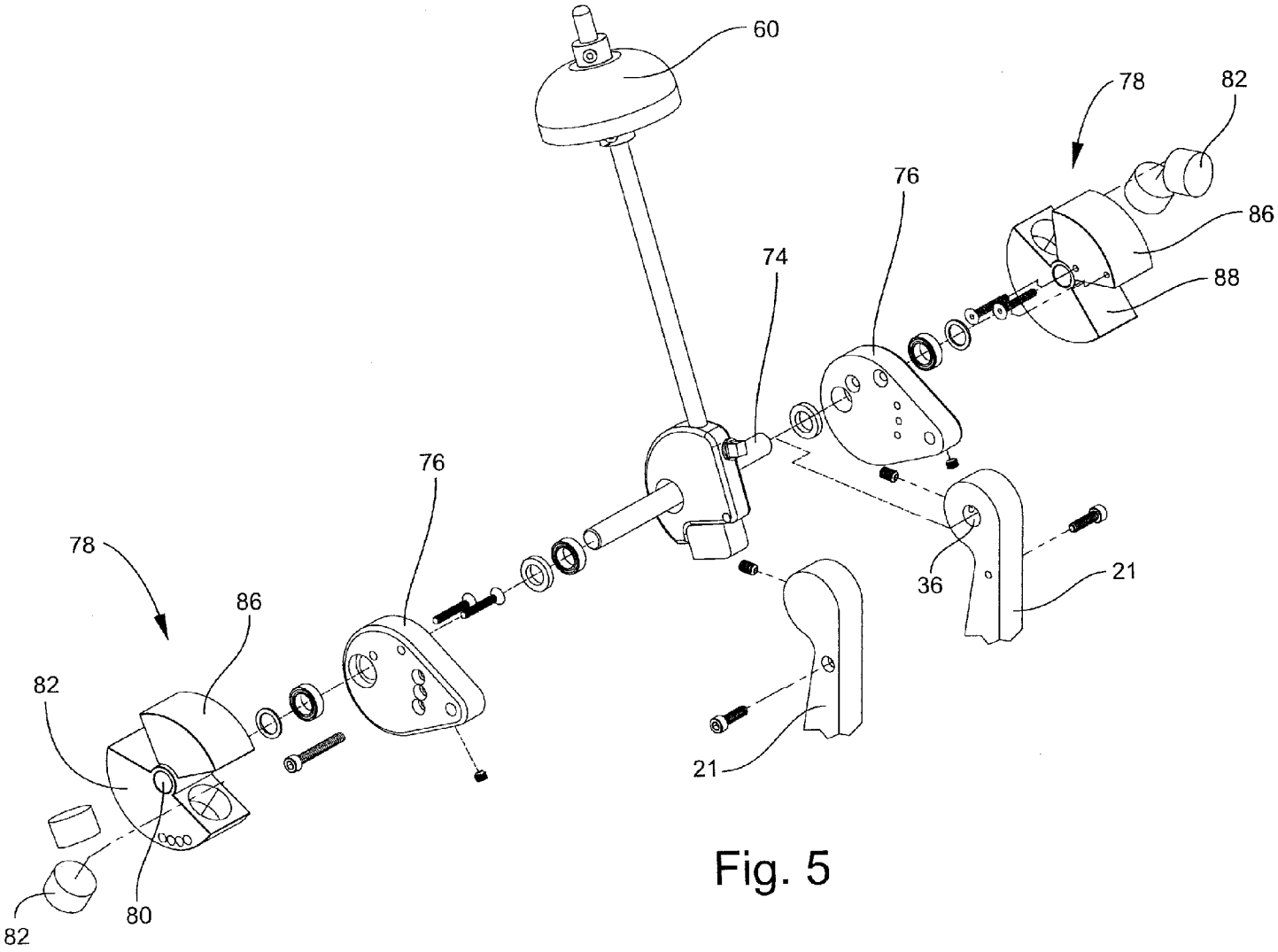
FIG. 5 is an exploded view of the magnetic return pedal.

In FIGS. 1-4, a magnetic return device 20 for a foot pedal mechanism 30 on a musical percussion instrument, such as a bass drum or a "hi hat" cymbal stand comprises at least one pair of high powered magnets 21A and 21B aligned for magnetic repulsion between a pedal 31 mounted to a base 34 by a hinge 35 and an elevated inclined mounting platform 24 on the base 34 for a smooth magnetic force return of the pedal after depressing and releasing the pedal 31. A pair of support columns extend perpendicularly from the base 34. The pedal 31 has a first end and a second end, whereby the hinge 35 engages the first end of the base 34 to the pedal 31. The second end of the pedal 31 is engaged to a rigid actuator arm 32 that is pivotally engaged to the pedal 31 by a pivot 33.

The device 20 comprises at least one pair of magnets including a first magnet 21A having a high gauss rating, which is adapted to be attached to a bottom of a foot pedal 31 by a bracket 28A or track and a second magnet 21B having a high gauss rating, which is adapted to be attached by a bracket 28B or track to an elevated inclined mounting platform 24 below the foot pedal 31. The second magnet 21B is aligned with the first magnet 21A with a maximum of mutually exposed magnetic surfaces so that the magnetic fields 22A and 22B are in polar repulsion between the magnets 21A and 21B so that after depression and release of the foot pedal 31 by a musician's foot, the foot pedal 31 is forced upwardly by the polar repulsion of the magnetic fields and of the magnets 21A and 21B.

The device 20 may further comprise additional pairs of magnets of lesser gauss rating than the first pair of magnets 21A and 21B, the pairs similarly mounted by stacking onto the high gauss magnets on the pedal 31 and inclined plane 24 on the base 34 for increased mutual magnetic repulsion with a more gradual transition due to the lower gauss magnets to assist in uplifting the pedal after repression of the pedal and smooth out the transition from downward to upward motion of the pedal 31.

The inclined magnet mounting platform 24, shown in FIG. 1, is adapted to be attached by recessed screws and washers or an adhesive to the base 34 below the pedal 31 of a musical percussion instrument with the platform 24 angled upwardly away from the hinge 35 so that the first and the second magnets 21A-21B are almost in contact at a low point of a depression of the pedal 31 for maximum repulsion between the magnetic fields of the magnets to cause the pedal 31 to respond instantly in returning to an upright position.

The magnet mounting platform 24, brackets 28A or track, and side plate assembly are preferably formed of a non-magnetic rigid material, such as aluminum or injection molded plastic so they do not interfere with the magnetic repulsion forces.

Figure 6:
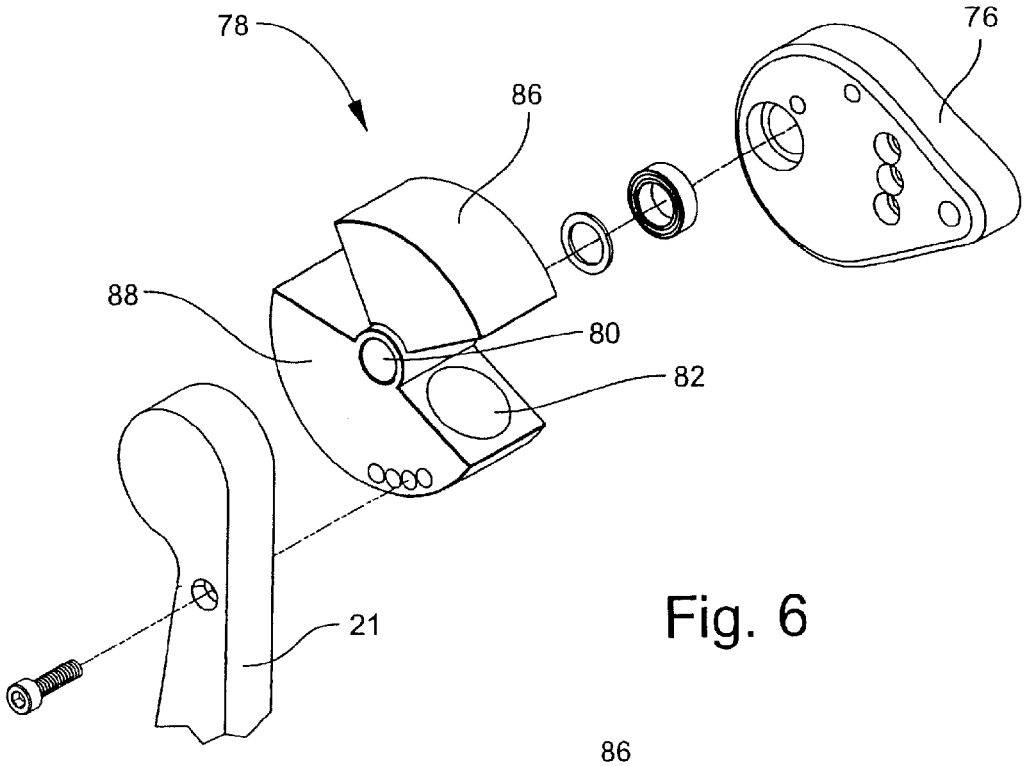
FIG. 6 is an exploded view of the cam and side plate assembly.
Figure 7:
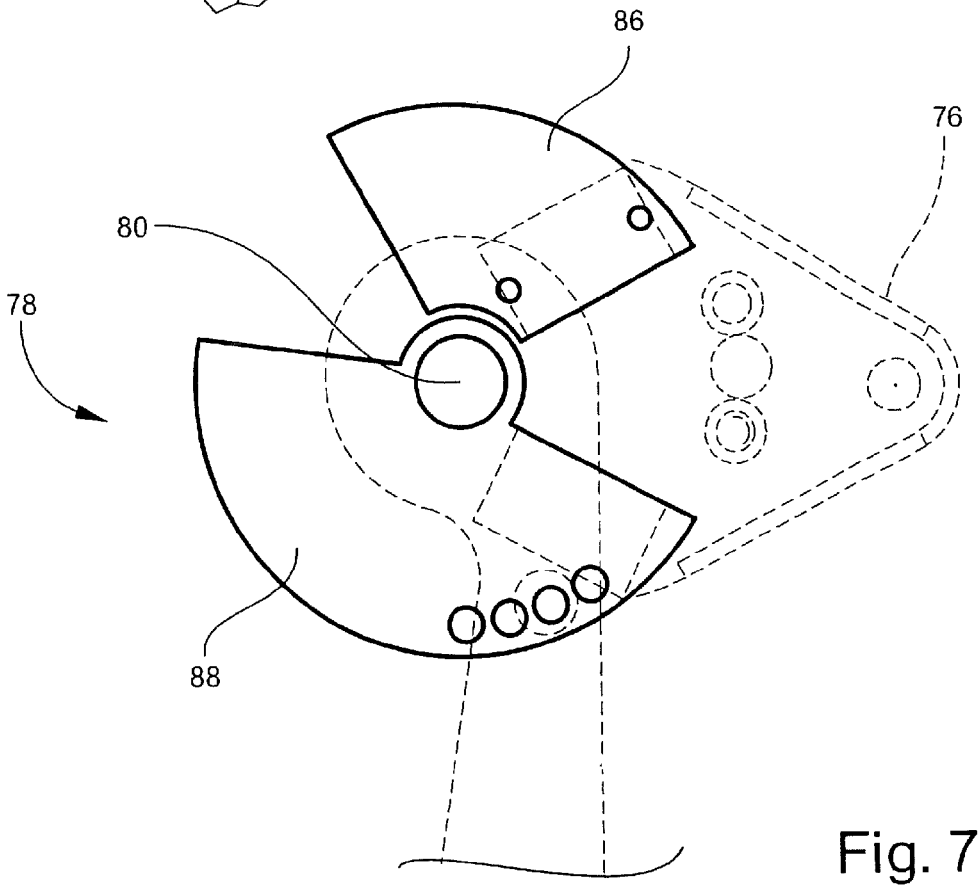
FIG. 7 is a side view of the left side of the rotor hub side plate assembly and cam.
Figure 8:
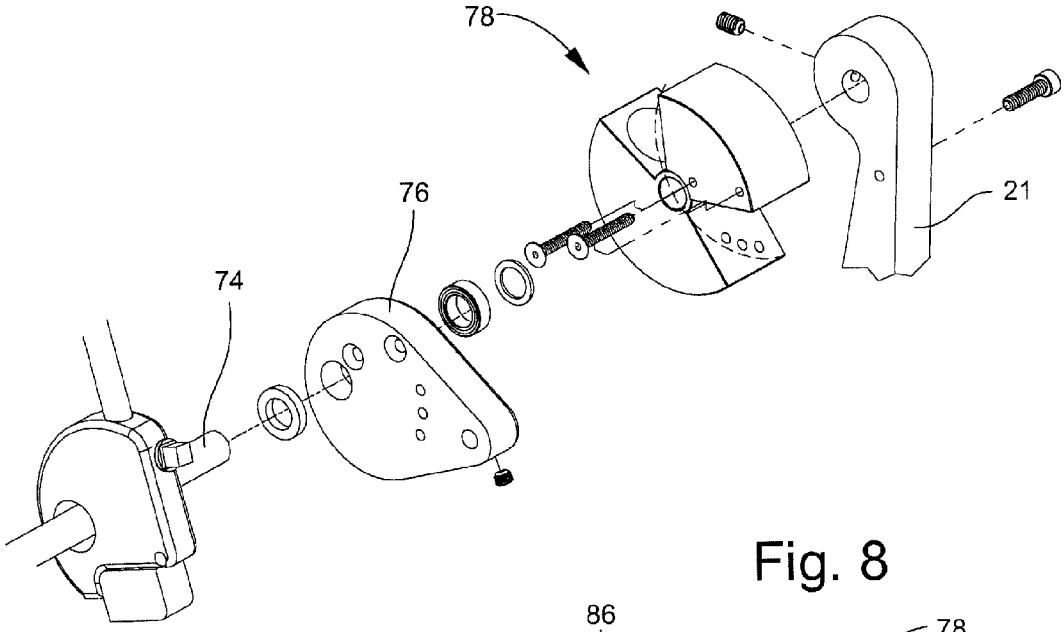
FIG. 8 is an exploded view of the cam and side plate assembly.

As illustrated in FIGS. 5-8, the top portion of each column 21 contains a bore 36 for receiving an axle 74 that is rotationally secured within the bores 36 of the column 21. A cam 76 is centrally located on the axle 74 and engaged to the rigid actuator arm 32. Disposed between the axle 74 and the cam 76 and along the axle 74 is a side plate assembly 78. As illustrated, the side plate assembly 78 has a top portion 86 and a bottom portion 88, wherein the top portion 86 and the bottom portion 88 are arcuate shaped. However, the side plate assembly 78 may be any shape, including, but not limited to, generally square, rectangular, triangular, trapezoidal, etc. As illustrated in FIGS. 6 and 7, the top portion 86 is engaged to the side of the cam 76 and moves in conjunction with the cam 76. The bottom portion 88 of the side plate assembly 78 may be engaged to the column 21 or similar structure. The top portion 86 rotationally moves above the bottom portion 88 along with the rotational movement of the cam 76. In other words, the bottom portion 88 is stationary and the top portion 86 rotates forwards and backwards in conjunction with the cam 76.

Figure 9:
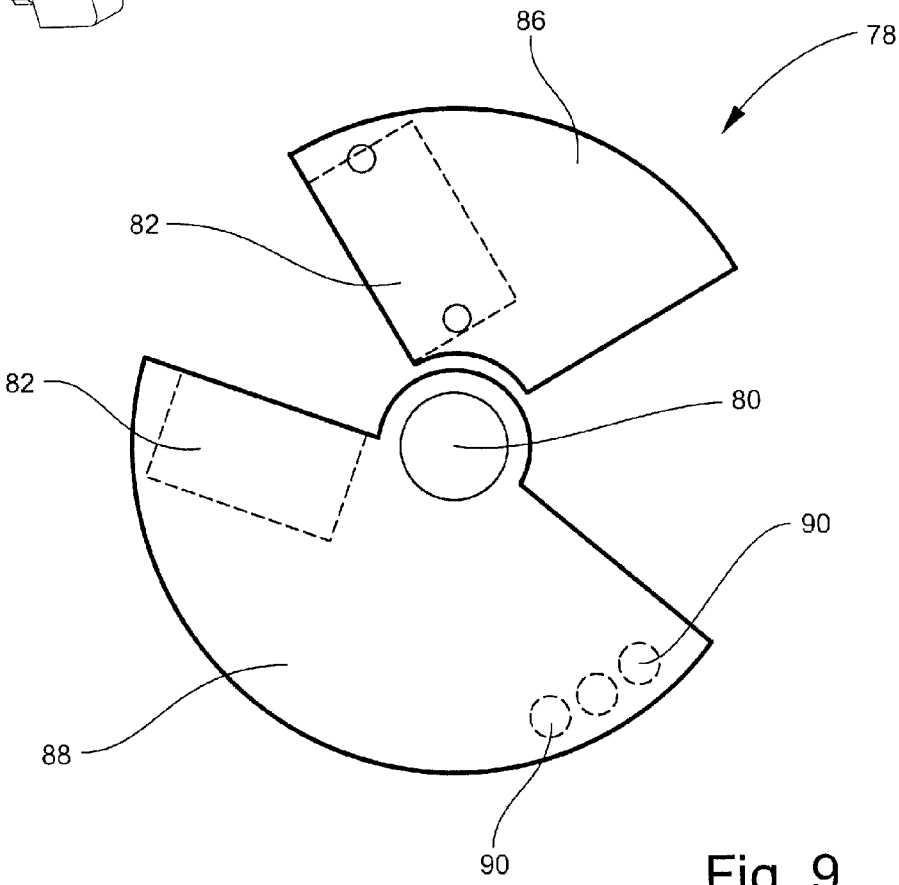
FIG. 9 is a side view of the side plate assembly.

The side plate assembly 78 also contains magnets 82 on at least one outer edge. The magnets 82 are contained within a bore formed on the outer edge of the side plate assembly 78. A magnet 82 is positioned on the edge of the top portion 86 of the side plate assembly 78 and a magnet is positioned on the edge of the bottom portion 88 of the side plate assembly 78, shown in FIGS. 7 and 9.

The top portion 86 of the side plate assembly 78 has a top side, a bottom side, a left side, a right side, a front side, and a back side. The top side and bottom side are curved, wherein the bottom side is adjacent the axle 74. The left side, right side, front side, and back side are generally straight surfaces. The magnet 82 is positioned within the front side of the top portion 86 of the side plate assembly 78.

The bottom portion 88 of the side plate assembly 78 has a top side, a bottom side, a left side, a right side, a front side, and a back side. The top side is curved and is opposite the axle 74, while the bottom side, left side, right side, front side, and back side are relatively straight surfaces. The magnet 82 is positioned within the front side of the bottom portion 88 of the side plate assembly 78. During use, the front side of the top portion 86 rotates towards the front side of the bottom portion 88 when the user pushes the pedal 31 with their foot. The top portion 86 is forcefully rotated away from the front side of the bottom portion 88, and the back side of the top portion 86 rotates towards the back side of the bottom portion 88. The bottom portion 88 contains a cylindrical bore 80 that extends outwardly from the back side of the bottom portion 88. The bottom portion 88 is rotationally engaged to the axle 74 through the cylindrical bore 80.

The magnets 82 have the same polar ends, meaning N-N or S-S, thereby repelling the magnets from each other and forcing the top portion 86 to rotate away from the bottom portion 88. Preferably, the side plate assembly 78 has a single magnet on the front side of the top portion 86 and the front side of the bottom portion 88. The front side of the top portion 86 and front side of the bottom portion 88 are in close proximity and face each other. In an alternative embodiment, the top portion 86 may have magnets on its front side and back side, and the bottom portion 88 may have magnets on its front side and back side. This arrangement allows the repulsion forces to assist the rotation of the cam in the clock-wise direction and the counter-clockwise direction.

In practice, the user depresses a musical instrument foot pedal 31 to pull down a rigid actuator arm 32 attached by a pivot 33 to the pedal 31 which causes the beater 60 to hit the drum. At the low point of the depression of the foot pedal 31 the pairs of magnets 21A and 21B come in close proximity, thereby creating opposing magnetic fields having magnetic repulsion therebetween, which return the pedal 31 upward to its original position after having been depressed. The magnets 82 preferable have high gauss ratings. Additionally, the magnets 82 on the side plate assembly 78 come in close proximity and the repulsive properties of the magnets aid in returning the cam 76 to the original position. Once the user removes his foot 40 from the foot pedal 31, the magnets 82 contained on the opposite side of the top portion and bottom portion force the cam 76 to rotate in the other direction being forced by the repulsive forces of the magnets 82.

The bottom portion 88 of the side plate assembly 78 contains a plurality of spaced apart adjustment holes 90 disposed along the outer edge of the side plate assembly 78. The holes 90 are aligned with a corresponding hollow on the adjacent column 21. A screw or bolt is inserted into a hole 90 and the corresponding hollow for retaining the bottom portion 88 of the side plate assembly 78 to the column 21. The bottom portion 88 is adjustable either clockwise or counterclockwise along the axle 74. The bottom portion 88 is moved to its desired position and a screw is positioned within the appropriate hole 90 that is aligned with the hollow of the column 21.

It is understood that the preceding description is given merely by way of illustration and not in limitation of the invention and that various modifications may be made thereto without departing from the spirit of the invention as claimed.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A magnetic return device for a foot pedal on a musical percussion instrument, the device comprising:

a first magnet having a high gauss rating adapted to be attached to a bottom of a foot pedal on a musical percussion instrument;

a second magnet having a high gauss rating adapted to be attached to a base below a foot pedal on a musical percussion instrument pair, the second magnet aligned with the first magnet so that the magnetic fields are in polar repulsion between the magnets so that after depression of a foot pedal by a musician, the foot pedal is forced upwardly by the polar repulsion of the magnetic fields of the magnets;

an actuator arm having a first end and a second end, the first end of the actuator arm is engaged to the foot pedal;

a first column and a second column, the first column and the second column extend perpendicularly from the base, the first column and the second column have a bottom portion and a top portion, wherein the bottom portion is engaged to the base and the top portion of each column contain a bore;

an axle having a first end and a second end, the first end of the axle is rotationally engaged to the bore of the first column and the second end of the axle is rotationally engaged to the bore of the second column;

a first cam and a second cam containing a bore for receiving the axle, the first cam is positioned is close proximity to the first column and the second cam is position in close proximity to the second column, the first cam and the second cam are engaged to the second end of the actuator arm;

a first side plate assembly and a second side plate assembly, wherein the first side plate assembly and second side plate assembly contain a top portion and a bottom portion, wherein the top portion contains a magnet and the bottom portion contains a magnet, the top portion of the first side plate assembly is engaged to the first cam and the top portion of the second side plate assembly is engaged to the second cam and the bottom portion of the first side plate assembly is engaged to the first column and the bottom portion of the second side plate assembly is engaged to the second column, whereby as the first cam and second cam are rotated about the axle the top portion of the first plate assembly and second plate assembly rotates in the clockwise and counterclockwise direction over the bottom portion of the first plate assembly and second plate assembly.

2. The device of claim 1, wherein a pair of spaced-apart columns extend perpendicularly upward from the base and an axle is disposed between the columns, the cam is rotationally engaged to the axle.

3. The device of claim 2, wherein a pair of spaced-apart columns extend perpendicularly upward from the base and the bottom portion of the side plate assembly is engaged to the columns.

4. The device of claim 1, wherein the bottom portion of the first side plate assembly and second side plate assembly contains a bore disposed therein for positioning a magnet.

5. The device of claim 1, further comprising a base that is hingedly connected to the foot pedal.

6. The device of claim 1 wherein the first side plate assembly and second side plate assembly is formed of aluminum.

7. The device of claim 1 wherein the first side plate assembly and second side plate assembly is formed of a molded synthetic.

8. The device of claim 1, wherein the bottom portion of the first side plate assembly and second side plate assembly contains a plurality of holes in close proximity to an outer edge that corresponds to a corresponding hollow contained in the first column and the second column and a nut is inserted into the holes of the bottom portion and the hollow for forming a secured arrangement.

9. The device of claim 1 wherein the device is adapted for use with a bass drum foot pedal.

10. The device of claim 1 wherein the device is adapted for use with a "hi hat" cymbal stand foot pedal.

11. The device of claim 1 wherein the top portion of the first plate assembly and the second side plate assembly contains an outer side and an inner side, the outer side and inner side are convexly shaped.

12. The device of claim 1, wherein wherein the bottom portion of the first plate assembly and the second side plate assembly contains an outer side and an inner side, the outer side is convexly shaped.

* * * * *